US007422549B2

(12) United States Patent
Matthews

(10) Patent No.: US 7,422,549 B2
(45) Date of Patent: Sep. 9, 2008

(54) BED-BICYCLE AND METHOD OF USE

(76) Inventor: George J. Matthews, 695 Seagull Breach Rd., Prince Frederick, MD (US) 20678

( * ) Notice: Subject to any disclaimer, the term of this patent is extended or adjusted under 35 U.S.C. 154(b) by 181 days.

(21) Appl. No.: 10/720,341

(22) Filed: Nov. 25, 2003

(65) Prior Publication Data

US 2004/0157708 A1 Aug. 12, 2004

Related U.S. Application Data

(60) Provisional application No. 60/428,941, filed on Nov. 26, 2002.

(51) Int. Cl.
*A63B 22/12* (2006.01)

(52) U.S. Cl. ..... 482/62; 601/24; 601/35

(58) Field of Classification Search ..... 482/51, 482/56, 57, 60, 62, 92, 148, 904; 601/23–27, 601/29, 32–37
See application file for complete search history.

(56) References Cited

U.S. PATENT DOCUMENTS

| | | | | | |
|---|---|---|---|---|---|
| 1,490,363 | A | | 4/1924 | Couplin | |
| 2,673,088 | A | | 3/1954 | Wentz | |
| 2,784,591 | A | * | 3/1957 | Shoor | 482/2 |
| 3,259,385 | A | | 7/1966 | Boren | |
| 3,455,295 | A | | 7/1969 | Kellogg | |
| 3,540,435 | A | * | 11/1970 | Smith | 601/36 |
| 3,596,654 | A | | 8/1971 | Tamura | |
| 3,693,614 | A | | 9/1972 | Schon | |
| 3,848,870 | A | * | 11/1974 | Craig | 482/44 |
| 3,910,571 | A | | 10/1975 | Stenn | |
| 4,169,591 | A | | 10/1979 | Douglas | |
| 4,262,902 | A | | 4/1981 | Dranselka | |
| 4,282,865 | A | | 8/1981 | Pogue | |
| 4,285,515 | A | | 8/1981 | Gezari | |
| 4,402,502 | A | | 9/1983 | Peters | |
| 4,478,213 | A | | 10/1984 | Redding | |
| 4,485,579 | A | | 12/1984 | Hawie | |
| 4,534,553 | A | | 8/1985 | Shirley | |
| 4,572,501 | A | | 2/1986 | Durham et al. | |
| 4,601,464 | A | * | 7/1986 | Mousel | 482/60 |
| 4,621,620 | A | | 11/1986 | Anderson | |
| 4,653,808 | A | | 3/1987 | Opsvik | |
| 4,739,984 | A | * | 4/1988 | Dranselka | 482/60 |
| 4,776,583 | A | | 10/1988 | Jennings | |

(Continued)

FOREIGN PATENT DOCUMENTS

DE 4113135 A1 * 10/1992

*Primary Examiner*—LoAn H. Thanh
*Assistant Examiner*—Tam Nguyen
(74) *Attorney, Agent, or Firm*—DLA Piper US LLP

(57) ABSTRACT

An easily-assembled bicycle for use by bed-ridden persons is provided. In an embodiment, the present invention is capable of being used in conjunction with both adjustable and non-adjustable beds or other person support. The present invention allows for hand or leg exercises or simultaneous hand and leg exercising (pedaling). In an embodiment, the bicycle includes an anchoring base unit, a top-side unit, a foot-pedal unit and a hand-pedal unit. Use of the present invention allows bed-ridden persons to exercise without depending on health-care workers and helps avoid the serious negative health consequences associated with lack of physical exercise (e.g., loss of muscle strength, calcium depletion, pulmonary embolism and bed sores).

10 Claims, 5 Drawing Sheets

U.S. PATENT DOCUMENTS 4,881,732 A * 11/1989 Kepiro ..... 482/62
4,925,184 A * 5/1990 McJunkin et al. ..... 482/60
4,974,840 A 12/1990 Welch
4,976,426 A * 12/1990 Szabo, et al. ..... 482/6
RE33,645 E 7/1991 Coote
5,033,223 A 7/1991 Minter
5,465,671 A 11/1995 Genest
5,472,396 A 12/1995 Brazaitis
5,514,053 A 5/1996 Hawkins et al.
5,598,789 A 2/1997 Jonker
5,743,050 A 4/1998 Shibata
5,820,519 A 10/1998 Slenker
5,833,581 A 11/1998 Johnston
5,860,941 A 1/1999 Saringer et al.
6,152,855 A 11/2000 Dean, Jr. et al.
6,164,607 A 12/2000 Hawkes
6,270,445 B1 8/2001 Dean, Jr. et al.
6,273,392 B1 8/2001 Birkhold
6,299,566 B1 10/2001 Wu
6,371,309 B1 4/2002 Smith

* cited by examiner

FIG. 3
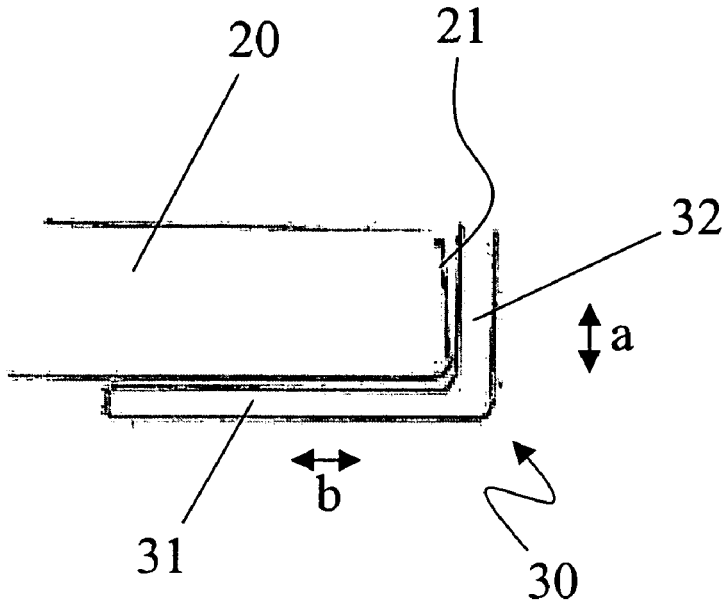
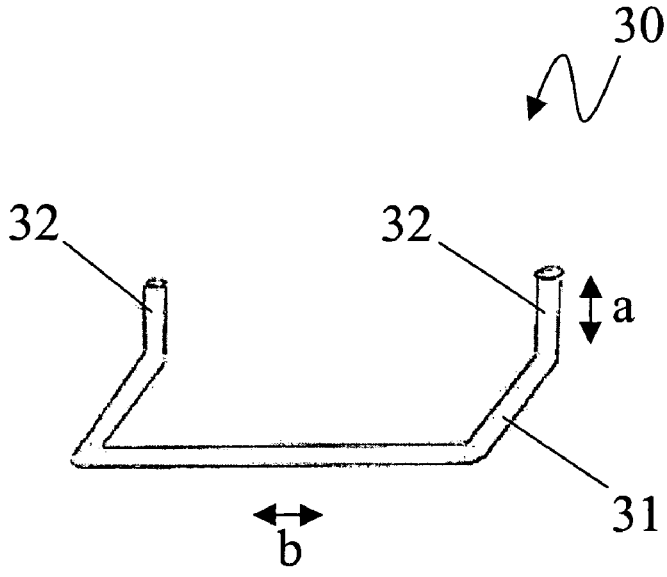
FIG. 4

FIG. 5
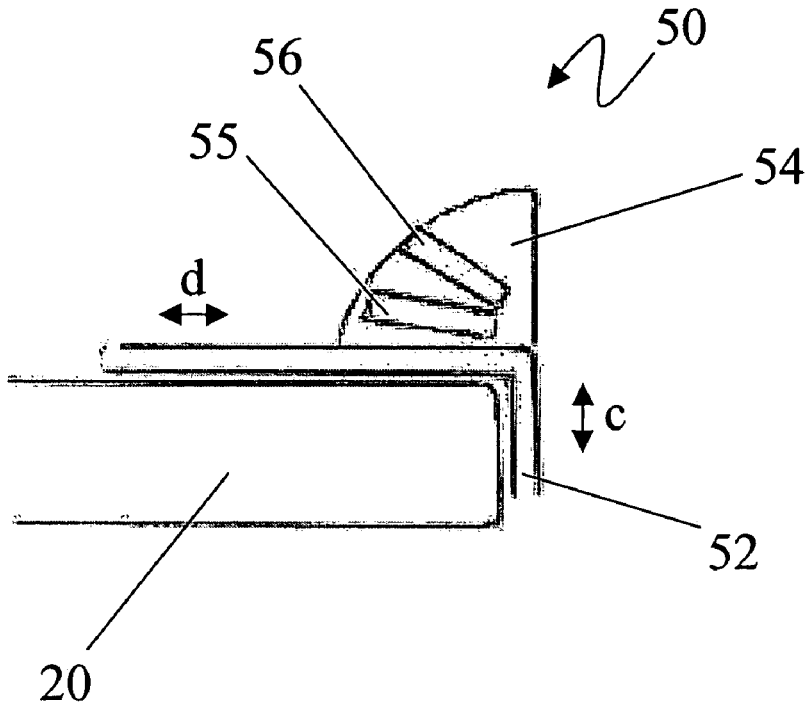
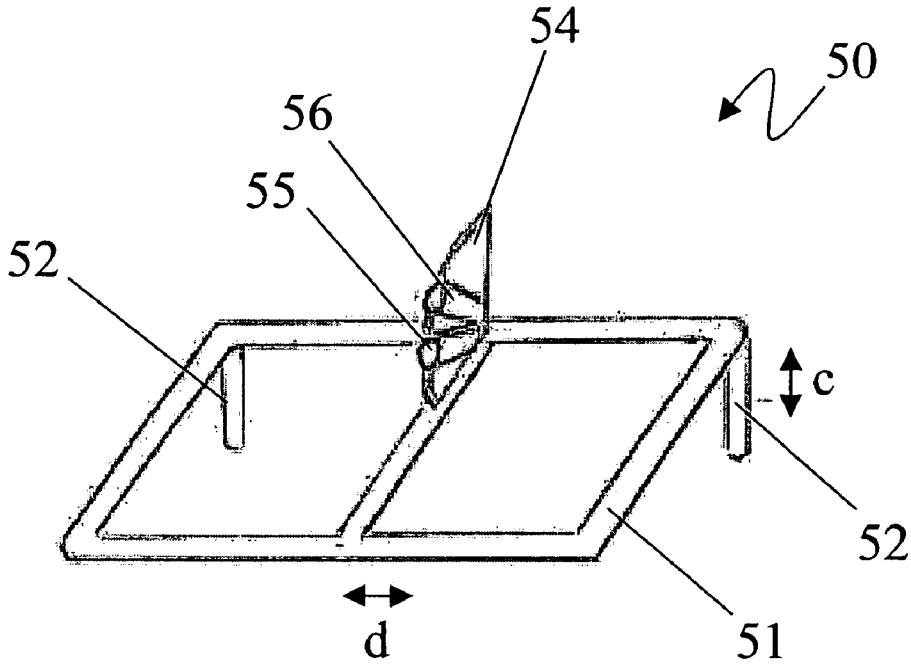
FIG. 6

BED-BICYCLE AND METHOD OF USE

This application claims priority from U.S. Provisional Application No. 60/428,941, filed Nov. 26, 2002. The entirety of that provisional application is incorporated herein by reference.

BACKGROUND OF THE INVENTION

1. Field of the Invention

The present invention relates generally to the field of medical exercise equipment, and more particularly to exercise equipment for use in bed.

2. Background of the Technology

People who are bed ridden for health reasons often suffer complications that result from the lack of physical exercise. One reason for this lack of exercise is that bed-ridden persons often exercise only when health workers, such as physical therapists, are available to assist and motivate them. Some of the serious consequences of lack of exercise in bed ridden people include the following:

1) Loss of muscle tone, strength and bulk, particularly for arm and leg muscles;
2) Depletion of calcium content of bones, making such bones brittle and prone to fracture;
3) Risk of blood clots (i.e., deep venus thrombosis) in the leg veins, that can break loose and travel to the lungs (i.e., pulmonary embolism) resulting in various life-threatening situations; and
4) Bed sores from sustained pressure on immobilized body parts.

Given the foregoing, there remains an unmet need for exercise equipment readily available and easily usable by bed-ridden patients and others while in bed.

SUMMARY OF THE INVENTION

The present invention, referred to in one embodiment and referred to interchangeably herein as a "bed bicycle" or "bed-bike," provides a stationary, bed adapted, bicycle-like exercise equipment device for separate or simultaneous arm and leg exercises, for use while the user is lying down, such as in bed. In one embodiment, the bed-bike is constructed of detachable sections that maybe assembled and taken apart easily. The bed-bike of this embodiment is thus capable of being assembled in place only during exercise sessions, so as, for example, not to impede other care-giving functions.

Further features and advantages of the present invention as well as the structure and operation of various embodiments of the present invention are described in detail below with reference to the accompanying drawings.

BRIEF DESCRIPTION OF THE FIGURES

The features and advantages of the present invention will become more apparent from the detailed description set forth below when taken in conjunction with the drawings in which like reference numbers indicate identical or functionally similar elements.

FIGS. 3 and 4 illustrate close up profile and perspective views, respectively, of an example anchoring base unit portion of a bed-bike, in accordance with an embodiment of the present invention;

FIGS. 5 and 6 illustrate close up profile and perspective views, respectively, of an example top-side unit portion of a bed-bike, in accordance with an embodiment of the present invention.

DETAILED DESCRIPTION

An exemplary embodiment of the bed-bike in accordance with the present invention will now be described in conjunction with the attached figures. The described embodiment is intended to be merely illustrative of various features in accordance with the present invention, and not limiting to the described example. In fact, after reading the following description, it will be apparent to those skilled in the relevant art(s) how to implement the following invention in alternative embodiments.

Figure 1:
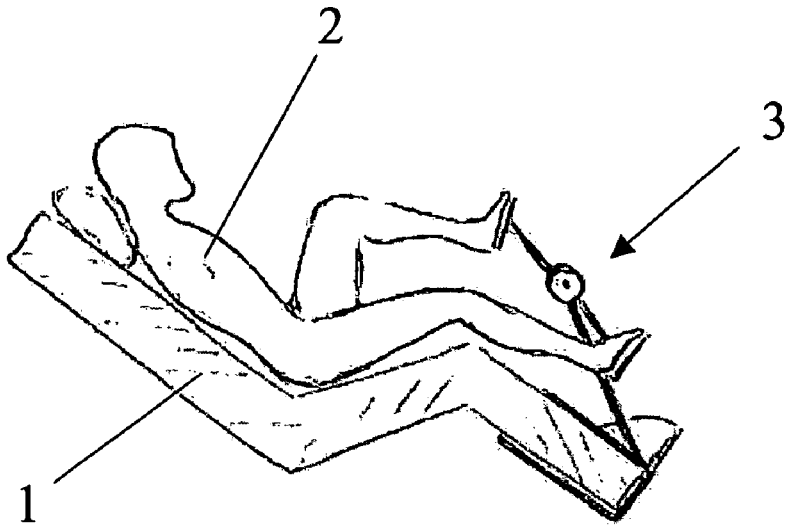
FIGS. 1 and 2 illustrate an exemplary embodiment of the bed-bike in operation, in accordance with the present invention.
Figure 2:
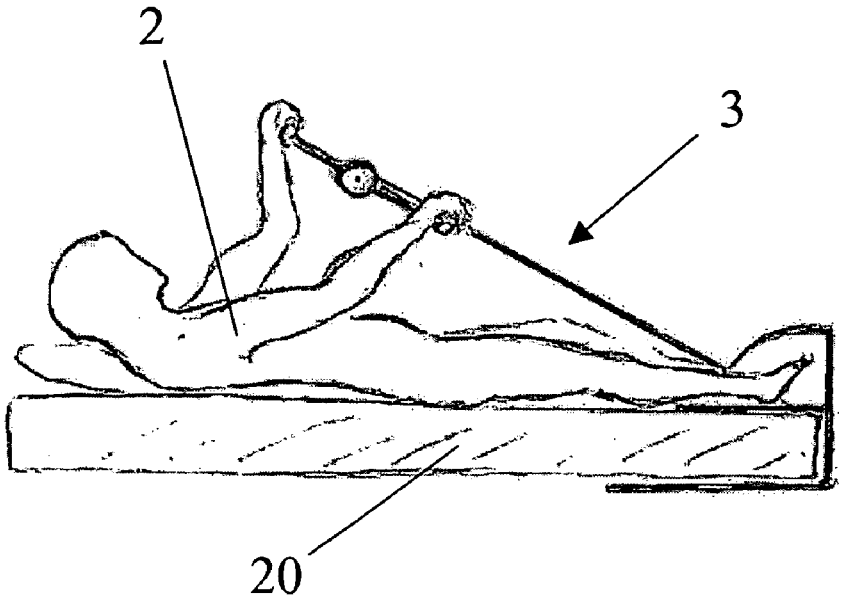

FIGS. 1 and 2 illustrate an exemplary embodiment of the bed-bike in operation, in accordance with the present invention. As shown in FIG. 1, in a first mode of operation, as used, for example with an adjustable bed or other support 1, a user 2, such as a bed-ridden patient, performs leg exercises (e.g., leg pedaling) using the device 3 positioned and adjusted for leg exercise use. In a second mode of operation, as shown in FIG. 2, a user 2 on a flat bed or other support 20 performs arm exercises (e.g., arm pedaling) using the device 3 positioned and adjusted for arm use. In one embodiment, both the leg and the arm pedaling devices may be simultaneously installed and used, as described further below with reference to FIGS. 5-7.

As described further below, the exemplary embodiments shown in FIGS. 1 and 2 include the following components/portions: an anchoring base unit; a top-side unit; a foot-pedal unit; and a hand-pedal unit.

FIGS. 3 and 4 show close up profile and perspective views, respectively, of an example anchoring base unit portion of a bed-bike, in accordance with an embodiment of the present invention. As shown in FIG. 3, the anchoring base unit 30 includes a frame portion 31, such as a rectangular hollow steel frame, that is positioned beneath and is stabilized (e.g., by friction and/or pinning) at, for example, the foot end of a bed mattress or other user support (e.g., mat, table, or like platforms) 20.

As further shown in FIGS. 3 and 4, the base unit 30 also includes attachment sections 32, perpendicularly oriented longitudinally a to plane b of the frame portion 31, as shown in FIG. 3, which, when used, for example, with a mattress 20, abut an end 21 of the mattress 20. The attachment sections 32 also serve as a connectors for a connecting top-side unit, further described below, with regard to FIGS. 5 and 6 and accompanying text.

FIGS. 5 and 6 present close up profile and perspective views, respectively, of an example top-side unit portion of a bed-bike, in accordance with an embodiment of the present invention. As shown in FIG. 5, the top-side unit 50 includes frame components, such as rectangular hollow steel portions. In one embodiment, a support section 51 of the unit 50 is designed to rest on the surface of a mattress or other user support 20. Connecting sections 52, perpendicularly oriented c longitudinally relative to the plane d of the support section 51, as shown in FIG. 5, are attachable to the attachment sections 32 of the anchoring base unit 20.

These sections 52, 32 may be connected in a variety of ways known in the art. For example, each of the sections may be constructed of rectangular hollow steel portions, with one section (e.g., 52) being shaped and/or sized such as to be insertable as a male portion into a corresponding female portion of the other section (e.g., 32). The sections may also optionally be lockably connected, as is know in the art, such as by pins, frictional fitting, or other locking mechanisms and/or techniques.

As also shown in FIGS. 5 and 6, a mounted housing 54, perpendicularly extending relative to the planar direction of the support section 51, is centered on the frame 50 with one or more pedal extension receiving features 55, 56 such as tubular sockets for receivably seating foot-pedal and hand pedal shafts, as known in the art and as described further below with regard to FIG. 7 and accompanying text. In one embodiment, both a foot pedal and an arm pedal are usable simultaneously via, for example, use of a foot pedal unit, as described further below with regard to FIG. 7, inserted into a first pedal receiving feature 55, and use of an arm pedal unit, as described further below with regard to FIG. 7, inserted in a second pedal receiving feature 56.

Figure 7:
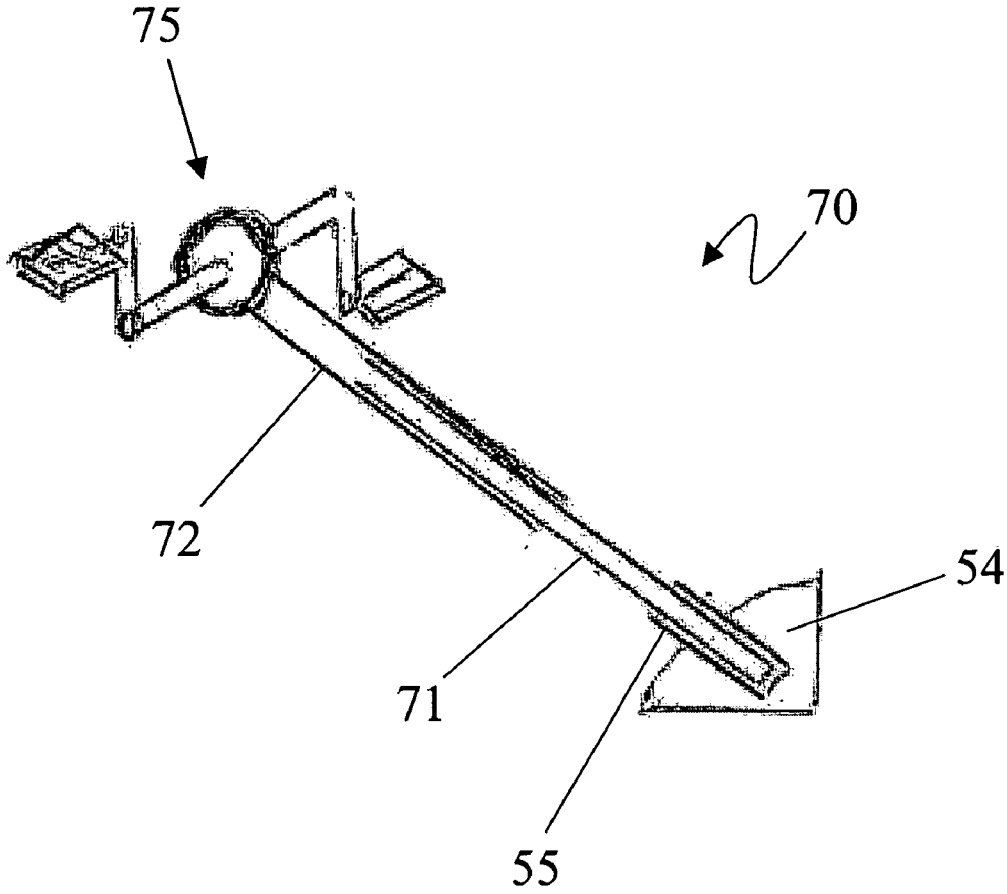
FIG. 7 is a diagram of an example foot-pedal or hand-pedal unit, in accordance with an embodiment of the present invention.
Figure 8:
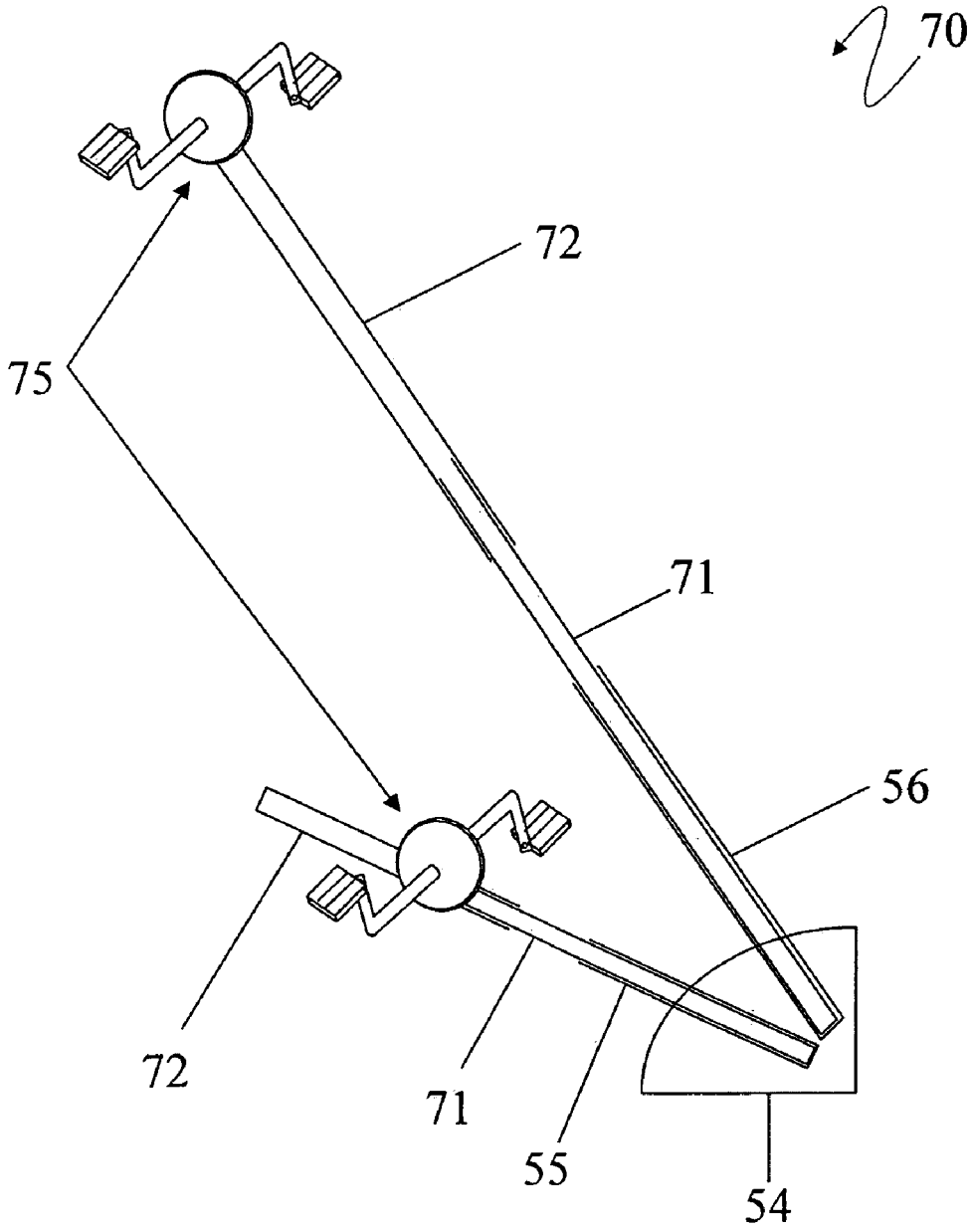
FIG. 8 illustrates an embodiment of the bed-bike having two pedal units that may be used simultaneously.

FIG. 7 is a diagram of an example foot-pedal or hand-pedal unit, in accordance with an embodiment of the present invention. As shown in FIG. 7, a foot-pedal or hand-pedal unit 70 is attachable to or via a pedal extension receiving feature 55, 56, as shown in greater detail in FIGS. 5 and 6. In one embodiment, the unit 70 includes one or more shaft portions 71, 72. For example, in one embodiment, a first shaft portion 71, such as a hollow steel shaft, is fittably and slidably receivable (or otherwise receivable, as is known in the art) into a socket pedal receiving feature 55, 56. To provide for adjustment of the length of the shaft, in this embodiment, a second shaft portion 72 is telescopingly slidably receivable in the first portion 71 (or receivable vice versa), and optionally lockable at a preferred position, such as via use of pins or other locking features known in the art.

Attached to the one or more shaft portions 71, 72 at an end opposite the end of the shaft portions 71, 72 attached to the pedal receiving feature 55, 56 is a rotatable or otherwise reciprocating pedal portion 75 for allowing pedaling motion by a user. As is known in the art, the pedal portion may optionally include features, such an adjustable frictional contact device contacting the central pedal shaft, to allow variable resistance to be provided to pedaling. Use of a longer shaft or shafts 71, 72 or adjustment of the shafts 71, 72 to lengthened positions allow use by the user's arms, as shown in FIG. 2, while use a shorter shaft or shafts 71, 72 or adjustment of the shafts 71, 72 to shortened positions allow use by the user's legs, as shown in FIG. 1.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above-described exemplary embodiments, but should be defined only in accordance with the following claims and their equivalents.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way.

What is claimed is:

1. An exercise device for use with a mattress of a bed, the device comprising:

a base unit made from a frame that includes a first portion having a substantially flat shape defining a first plane, and two ends; and a second portion extending perpendicularly upward from each of said ends;

a top-side unit made from a frame that includes a first portion having a substantially flat shape defining a second plane; and a second portion extending perpendicularly downward from each of two adjacent corners of the first portion of the top-side unit to engage the second portion of the base unit such that the first plane of first portion of the base unit is parallel to the second plane of the first portion of the top-side unit; and a first pedal unit that includes a first pedal portion with pedals and a shaft extending from the pedal portion adjustably connecting the pedal portion, diagonally relative to the second plane, to a first receiving end located on said top-side unit wherein the first portion of the base unit is adapted to be positioned directly below a mattress of a bed, the second portion of the base unit is adapted to abut an end of said mattress; the first portion of the top-side unit is adapted to be positioned to rest on a surface of said mattress above the first portion of the base unit and the second portion of the top-side unit is adjustably engaged with the second portion of the base such that the mattress is effectively clamped between the base unit and the top side-unit to allow a person laying on said mattress to exercise by rotating the pedals via their hands and/or feet.

2. The exercise device of claim 1, further comprising a second pedal unit, wherein the second pedal unit includes a second pedal portion with pedals and at least one shaft connecting said second pedal portion to a second receiving end located on said top-side unit; wherein said pedals of the first and second pedal portions are adapted to be used with said person's hands and/or feet.

3. The exercise device of claim 2 further comprises a housing that encloses said first and second receiving ends located on said top-side unit, and said housing extends perpendicularly from said first portion of said top-side unit.

4. The exercise device of claim 1, wherein the base unit is a hollow steel frame.

5. The exercise device of claim 1, wherein the top-side unit is a hollow steel frame.

6. The exercise device of claim 1, wherein the second portion of the top-side unit is a male hollow frame insertable into the second portion of the base unit, wherein the second portion of the base unit is a female hollow frame.

7. The exercise device of claim 2 wherein the first pedal portion and the second pedal portion are connected to the first receiving end and the second receiving end respectively, each by a shaft comprising a plurality of telescopically slidable shaft portions.

8. The exercise device of claim 1, wherein the substantially flat shape of the first portion of the base is a C shape configuration.

9. The exercise device of claim 1, wherein the substantially flat shape of the first portion of the top-unit is a rectangular shape configuration.

10. The exercise device of claim 1, wherein the shaft is length adjustable and/or angularly adjustable.

* * * * *